US007273508B2

(12) United States Patent
Sato et al.

(10) Patent No.: US 7,273,508 B2
(45) Date of Patent: Sep. 25, 2007

(54) IRON-BASED SINTERED ALLOY MATERIAL FOR VALVE SEAT

(75) Inventors: Kenichi Sato, Shimotsuga-gun (JP); Arata Kakiuchi, Shimotsuga-gun (JP); Teruo Takahashi, Shimotsuga-gun (JP); Tomoki Okita, Wako (JP); Masahiro Takehana, Wako (JP)

(73) Assignees: Nippon Piston Ring Co., Ltd., Tochigi-ken (JP); Honda Motor Co., Ltd., Tokyo (JP)

( * ) Notice: Subject to any disclaimer, the term of this patent is extended or adjusted under 35 U.S.C. 154(b) by 383 days.

(21) Appl. No.: 11/070,668

(22) Filed: Mar. 3, 2005

(65) Prior Publication Data

US 2005/0193861 A1 Sep. 8, 2005

(30) Foreign Application Priority Data

Mar. 3, 2004 (JP) ..... 2004-058958

(51) Int. Cl.
*C22C 33/02* (2006.01)

(52) U.S. Cl. ..... 75/243; 75/246

(58) Field of Classification Search ..... 75/243, 75/246

See application file for complete search history.

(56) References Cited

U.S. PATENT DOCUMENTS

| | | | | |
|---|---|---|---|---|
| 5,031,878 | A * | 7/1991 | Ishikawa et al. | 251/368 |
| 5,759,227 | A * | 6/1998 | Takahashi et al. | 75/246 |
| 5,870,989 | A * | 2/1999 | Takahashi et al. | 123/188.3 |
| 6,139,599 | A * | 10/2000 | Takahashi et al. | 75/246 |
| 6,318,327 | B1 * | 11/2001 | Takahashi et al. | 123/188.3 |
| 2002/0084004 | A1 * | 7/2002 | Takahashi et al. | 148/320 |
| 2004/0069094 | A1 * | 4/2004 | Sato et al. | 75/246 |
| 2004/0103753 | A1 * | 6/2004 | Ando | 75/243 |

* cited by examiner

*Primary Examiner*—Ngoclan T. Mai
(74) *Attorney, Agent, or Firm*—Crowell & Moring LLP

(57) ABSTRACT

An iron-based sintered alloy material for a valve seat having improved wear resistance and reduced opposite aggressibility to a mating valve. The iron-based sintered alloy material contains 10% to 20% by area of first hard particles and 15% to 35% by area of second hard particles dispersed in a base matrix phase, the first and the second hard particles accounting for 25% to 55% by area in total. The first hard particles are composed of a cobalt-based intermetallic compound and have a size of 10 to 150 μm and a hardness of at least 500HV0.1 and less than 800HV0.1. The second hard particles are composed of a cobalt-based intermetallic compound and have a size of 10 to 150 μm and a hardness of at least 800HV0.1 and less than 1100HV0.1. Solid lubricant particles may also be dispersed in the base matrix phase.

9 Claims, 2 Drawing Sheets

IRON-BASED SINTERED ALLOY MATERIAL FOR VALVE SEAT

BACKGROUND OF THE INVENTION

1. Field of the Invention

The present invention relates to an iron-based sintered alloy material suitable for a valve seat in internal combustion engines, and particularly to an iron-based sintered alloy material having improved wear resistance and reduced opposite aggressibility to mating material.

2. Description of the Related Art

Sintered alloy material is commonly manufactured by blending, mixing and kneading the raw materials to produce a mixed powder, compressing the resulting mixture in a mold, and sintering the resulting compact at a predetermined temperature in a predetermined atmosphere. Thus, metals or alloys that are difficult to produce by common melting and solidification processes can be easily manufactured in the form of sintered alloy material. In addition, since multiple functions can be easily combined in the sintered alloy material, a component having a particular function can be easily produced. The sintered alloy material is also suitable to produce a porous material, a material having a low machinability, and a component in a complicated shape.

A valve seat is press-fit or joined to a cylinder head in an internal combustion engine, preventing leakage of combustion gas and cooling a valve. The valve seat is therefore hit by the valve, wears by friction, is heated by the combustion gas, and is exposed to corrosive combustion products. Thus, the valve seat requires heat resistance and wear resistance, and the sintered alloy material has recently been used in such a valve seat.

In view of environmental protection, automobile engines have been required to have an extended life, higher power, and improved fuel efficiency, and to emit cleaner exhaust gas. To satisfy such demands, the automobile engines are operated under severer conditions, and accordingly valve seats are also exposed to severer environments. In such environments, conventional valve seats may have insufficient heat resistance and wear resistance.

To address such problems, Japanese Unexamined Patent Application Publication No. 5-43913 discloses a valve seat composed of an iron-based sintered alloy material having reduced opposite aggressibility to mating material. This valve seat is composed of 5% to 25% by weight of spherical carbide-dispersed hard particles and/or intermetallic compound-dispersed particles, each particle having a microvickers hardness (MHV) of 500 to 1800 and being dispersed in a matrix. With such a micro structure, the valve seat is claimed to have reduced opposite aggressibility to mating material. The intermetallic compound-dispersed particles may be composed of Mo: 20% to 40%, Cr: 5% to 15%, and Si: 1% to 5%, the balance being Co and unavoidable impurities.

Japanese Unexamined Patent Application Publication No. 11-6040 proposes an wear-resistant iron-based sintered alloy in which 2% to 30% by weight of nickel-based hard particles and/or 2% to 4% by weight of intermetallic hard particles that have higher hardness than the nickel-based hard particles, such as Fe—Mo, Fe—W, or Fe—Cr, are dispersed in a matrix that is formed by mixing and sintering an Fe—Co—Mo— based alloy powder and an Fe—Cr— based alloy powder. With such a structure, this iron-based sintered alloy is claimed to have reduced opposite aggressibility to mating material and increased wear resistance.

Japanese Unexamined Patent Application Publication No. 2003-268414 also proposes a sintered alloy for a valve seat in which 1% to 3% by weight of enstatite particles, 15% to 25% by weight of hard alloy particles (A) having a HV of 500 to 900, and 5% to 15% by weight of hard alloy particles (B) having a HV of 1000 or more are dispersed in a sintered alloy skeleton matrix containing carbides of Cr, Mo, W, and V, and pores in the skeleton matrix are infiltrated with copper or a copper alloy. The structure composed of two types of hard particles having different hardness is claimed to improve the wear resistance of the valve seat and to reduce the wear loss of a mating valve. The hard alloy particles (B) may be ferromolybdenum particles or high-alloy hard particles containing tungsten.

SUMMARY OF THE INVENTION

The following is the summary of the present invention.

(1) An iron-based sintered alloy material for a valve seat, comprising:

a base matrix phase;

first hard particles; and second hard particles, wherein the first hard particles and the second hard particles have different hardness and are dispersed in the base matrix phase, the first hard particles are composed of a cobalt-based intermetallic compound and have a size of 10 to 150 μm and a hardness of 500HV0.1 or more and less than 800HV0.1, the second hard particles are composed of a cobalt-based intermetallic compound and have a size of 10 to 150 μm and a hardness of 800HV0.1 or more and less than 1100HV0.1, the first hard particles occupy 10% to 20% by area, the second hard particles occupy 15% to 35% by area, and the first hard particles and the second hard particles occupy 25% to 55% by area in total.

(2) An iron-based sintered alloy material for a valve seat according to (1), wherein the first hard particles may contain 0.5% to 4.0% by mass of Si, 5.0% to 20.0% by mass of Cr, and 20.0% to 40.0% by mass of Mo, the balance being Co and unavoidable impurities, and the second hard particles may contain 0.5% to 4.0% by mass of Si, 5.0% to 20.0% by mass of Ni, 15.0% to 35.0% by mass of Cr, and 15.0% to 35.0% by mass of Mo, the balance being Co and unavoidable impurities.

(3) An iron-base sintered alloy material for a valve seat according to (1) or (2), wherein a base matrix, which is composed of the base matrix phase and the first and the second hard particles, may contain 0.5% to 3.0% by mass of C, 0.5% to 2.0% by mass of Si, 2.0% to 8.0% by mass of Ni, 3.0% to 13.0% by mass of Cr, 7.0% to 15.0% by mass of Mo, 0.5% to 4.0% by mass of Cu, and 12.0% to 26.0% by mass of Co, the balance being Fe and unavoidable impurities.

(4) An iron-base sintered alloy material for a valve seat according to any of (1) through (3), wherein, in addition to the first hard particles and the second hard particles, 0.2% to 3.0% by area of solid lubricant particles may be dispersed in the base matrix phase.

(5) An iron-base sintered alloy material for a valve seat wherein a valve seat composed of the iron-based sintered alloy material according to any of (1) through (4).

DESCRIPTION OF THE PREFERRED EMBODIMENTS

Figure 1:
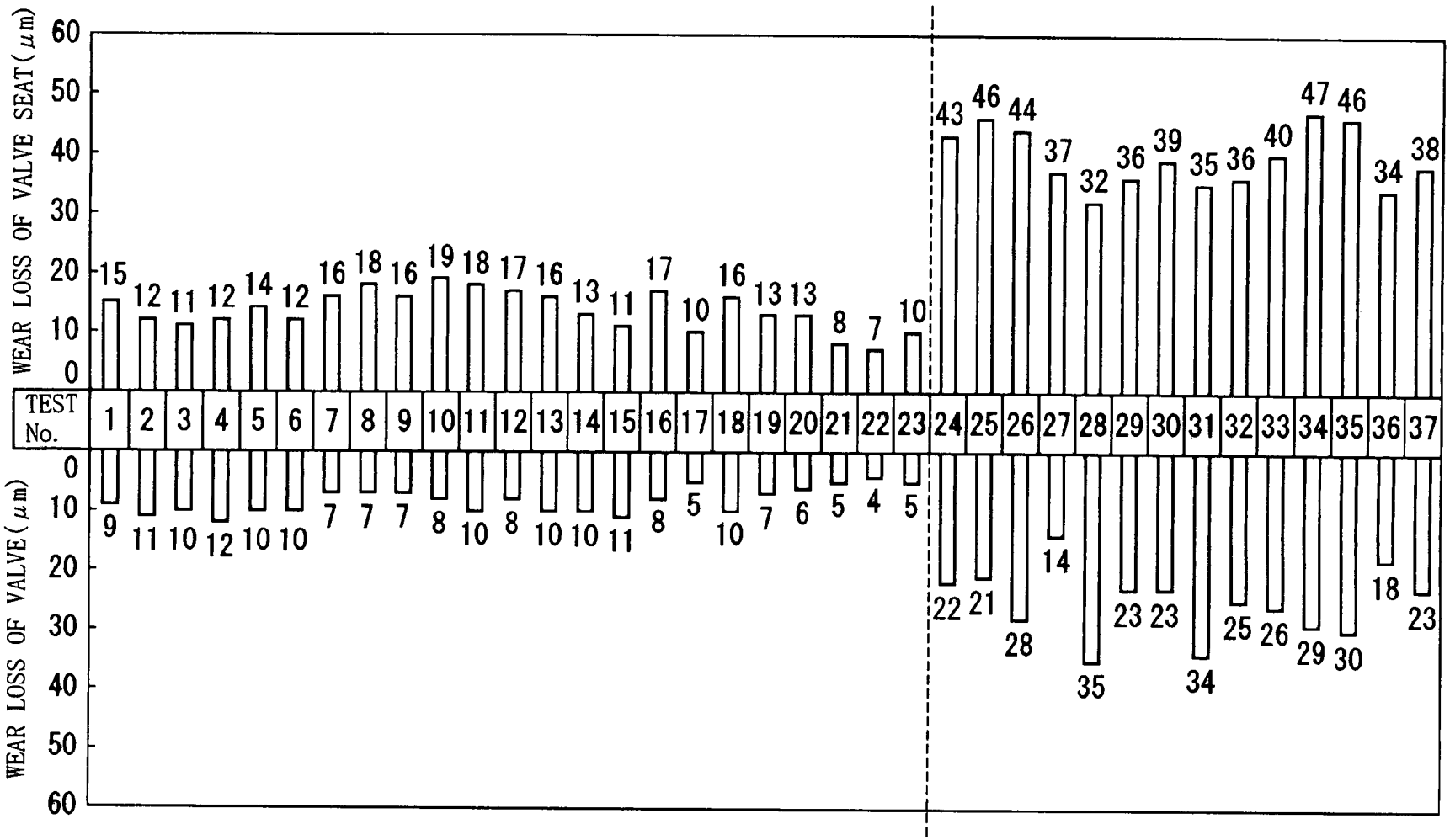
FIG. 1 is a graph comparing the wear loss of a valve seat according to an embodiment of the present invention with that of a mating valve.

Recent gasoline internal combustion engines have been required to have extended lives, higher powers, and improved fuel consumption, and to emit cleaner exhaust gases, in view of environmental protection. To increase fuel consumption and to clean exhaust gases, air-fuel (A/F) ratios are getting higher in the recent gasoline internal combustion engines. This causes to achieve nearly perfect combustion, and thus increases the combustion temperature and reduces combustion products of gasoline. Thus, the contact between a valve seat and a mating valve is more likely to be metallic contact. This increases the possibility of adhesive wear.

Under such severe conditions, the valve seats manufactured by the methods described in the Japanese Unexamined Patent Application Publication Nos. 5-43913, 11-6040, and 2003-268414 may fail to satisfy the desired wear resistance and heat resistance, depending on the operation condition of the internal combustion engine.

In light of such existing problems, an object of the present invention is to provide an iron-based sintered alloy material for a valve seat having improved wear resistance and reduced opposite aggressibility to a mating valve, even under such severe conditions that adhesive wear is more likely to occur in the recent gasoline internal combustion engines.

To this end, the present inventors have intensively studied how the type and the quantity of hard particles dispersed in a sintered alloy matrix affect the wear resistance and the opposite aggressibility to mating material. Consequently, the present inventors found that the carbide-dispersed hard particles as described in the Japanese Unexamined Patent Application Publication No. 5-43913 have some effect of reinforcing the matrix, but have a little effect of improving the wear resistance under such conditions that adhesive wear is more likely to occur. Furthermore, a great number of carbide-dispersed hard particles may increase the opposite aggressibility to a mating valve.

The present inventors also found that intermetallic compound particles, such as Fe—Mo, Fe—W, and Fe—Cr, described in the Japanese Unexamined Patent Application Publication Nos. 11-6040 and 2003-268414 have high hardness and improve the wear resistance of the valve seat. However, a great number of intermetallic compound particles may increase the opposite aggressibility to a mating valve. Furthermore, the intermetallic compound particles may crack or chip in operation under severe conditions as in recent gasoline internal combustion engines, and the resulting fine particles accelerate the abrasion wear of the valve and the valve seat. In addition, the intermetallic compound particles have poor diffusion property to the matrix during sintering and thus have a low bonding strength with the matrix. Accordingly, the hard particles may fall off from the matrix in operation, causing the wear resistance to decrease below a desired value.

In this way, the present inventors found that the dispersion of two types of hard particles in the matrix, that is, particles having reduced opposite aggressibility to mating material and particles having high hardness, high wear resistance, and an excellent sintering diffusion property to the matrix, could achieve both improved wear resistance of the valve seat and reduced opposite aggressibility to mating material. The present inventors also found that cobalt-based intermetallic compound particles having a size of 10 to 150 μm and a hardness of 500HV0.1 or more and less than 800HV0.1 are adequate for the particles having reduced opposite aggressibility to mating material, and cobalt-based intermetallic compound particles having a size of 10 to 150 μm and a hardness of 800HV0.1 or more and less than 1100HV0.1 are adequate for the particles having high wear resistance and an excellent sintering diffusion property to the matrix. The present invention is accomplished based on the findings described above after careful consideration.

In an iron-based sintered alloy material for a valve seat according to the present invention, two types of hard particles having different hardness are dispersed in a base matrix phase. Both of the two types of hard particles are cobalt-based intermetallic compound particles. The cobalt-based intermetallic compound particles contain hard intermetallic compounds dispersed in a relatively soft cobalt matrix, and smoothly diffuse into the base matrix phase of the iron-based sintered alloy material during sintering. Thus, the bonding strength between the hard particles and the base matrix phase is large enough to prevent the hard particles from falling off from the matrix in operation.

The first hard particles are cobalt-based intermetallic compound particles having a size of 10 to 150 μm and a hardness of 500HV0.1 or more and less than 800HV0.1. The hardness of the hard particles is measured with a microvickers hardness tester (load: 1 N). The size of the hard particles is measured directly. The hard particles having a hardness of 500HV0.1 or more and less than 800HV0.1 is harder than the base matrix phase. Thus, they increase the wear resistance of the valve seat, have reduced opposite aggressibility to mating material, and improve a self-lubricating property. The term "self-lubricating property" means that the adhesion between two metals is minimized when they are in contact with each other. The hardness of the hard particles less than 500HV0.1 results in insufficient wear resistance. The hardness of the hard particles of 800HV0.1 or more results in larger opposite aggressibility to mating material.

When the hard particles have a size less than 10 μm, they easily diffuse into the base matrix phase during sintering and are no longer expected to work as hard particles. When the hard particles have a size over 150 μm, they are prone to crack or chip in operation and thereby the opposite aggressibility to mating material may increase.

Preferably, the first hard particles are composed of 0.5% to 4.0% by mass of Si, 5.0% to 20.0% by mass of Cr, and 20.0% to 40.0% by mass of Mo, the balance being Co and unavoidable impurities. When the contents of Si, Cr, and Mo are out of the above-mentioned ranges, the content of the intermetallic compound goes out of an appropriate level, and thereby it becomes difficult to adjust the hardness of the hard particles to the range of 500HV0.1 or more and less than 800HV0.1.

The first hard particles according to the present invention are dispersed at 10% to 20% by area. Less than 10% by area of the first hard particles are insufficient to increase the wear resistance and to improve the self-lubricating property. On the other hand, although more than 20% by area of the first hard particles improve the self-lubricating property, an increase in the wear resistance corresponding to the content of the first hard particles cannot be expected.

The second hard particles are cobalt-based intermetallic compound particles having a size of 10 to 150 μm and a hardness of 800HV0.1 or more and less than 1100HV0.1.

Use of the cobalt-based intermetallic particles increases the bonding strength with the base matrix phase. This prevents the hard particles from falling off from the matrix in operation and thereby prevents the wear resistance from decreasing. While the hard particles having a hardness of 800HV0.1 or more and less than 1100HV0.1 increase the opposite aggressibility to mating material, they remarkably increase the wear resistance of the valve seat. The hard particles having a hardness of 1100HV0.1 or more have lower toughness, and are prone to crack or chip and easily fall off from the matrix in operation.

When the hard particles have a size less than 10 μm, they easily diffuse into the base matrix phase during sintering and are no longer expected to work as hard particles. When the hard particles have a size over 150 μm, they are prone to crack or chip in operation and thereby the opposite aggressibility to mating material may increase.

Preferably, the second hard particles are composed of 0.5% to 4.0% by mass of Si, 5.0% to 20.0% by mass of Ni, 15.0% to 35.0% by mass of Cr, and 15.0% to 35.0% by mass of Mo, the balance being Co and unavoidable impurities. When the contents of Si, Ni, Cr, and Mo are out of the above-mentioned ranges, the content of the intermetallic compound goes out of an appropriate level, and thereby it becomes difficult to adjust the hardness of the hard particles to the range of 800HV0.1 or more and less than 1100HV0.1.

The second hard particles according to the present invention are dispersed at 15% to 35% by area. While less than 15% by area of the second hard particles can reduce the opposite aggressibility to mating material, they decrease the wear resistance of the valve seat. On the other hand, more than 35% by area of the second hard particles result in too much increase in the opposite aggressibility to mating material.

The first and the second hard particles according to the present invention are dispersed within the above-mentioned ranges and at 25 to 55% by area in total. This remarkably increases the wear resistance of the valve seat and decreases the opposite aggressibility to mating material. However, when the first and the second hard particles are less than 25% by area in total, it is difficult to achieve both improved wear resistance and reduced opposite aggressibility to mating material. On the other hand, when the first and the second hard particles are more than 55% by area in total, the effects are saturated and therefore the cost effectiveness decreases. In addition, this may decrease the strength and the wear resistance of the valve seat. Thus, the total content of the first and the second hard particles is limited to 25% to 55% by area. The first hard particles or the second hard particles alone cannot achieve both improved wear resistance and reduced opposite aggressibility to mating material.

The following are preferred compositions of a base matrix composed of a base matrix phase and two types of hard particles.

In the iron-based sintered alloy material for a valve seat according to the present invention, the base matrix preferably contains 0.5% to 3.0% by mass of C, 0.5% to 2.0% by mass of Si, 2.0% to 8.0% by mass of Ni, 3.0% to 13.0% by mass of Cr, 7.0% to 15.0% by mass of Mo, 0.5% to 4.0% by mass of Cu, and 12.0% to 26.0% by mass of Co, the balance being Fe and unavoidable impurities.

C: 0.5% to 3.0% by mass

Carbon is contained in the base matrix phase and reinforces the base matrix phase. Therefore, Carbon is preferably contained at 0.5% by mass or more. However, more than 3.0% by mass of carbon accelerates the formation of carbide and thus decreases the toughness. Thus, the carbon content is preferably limited to 0.5% to 3.0% by mass.

Si: 0.5% to 2.0% by mass

Silicon is contained in the base matrix phase and the hard particles, and reinforces the base matrix phase and increases the wear resistance. In the present invention, Silicon is preferably contained at 0.5% by mass or more. The reinforcement of the base matrix phase is insufficient at the silicon content less than 0.5% by mass. However, the effects almost level off at the silicon content more than 2.0% by mass. Thus, the silicon content is preferably limited to 0.5% to 2.0% by mass.

Ni: 2.0% to 8.0% by mass

Nickel is contained in the base matrix phase and the hard particles, and increases the wear resistance, the hardness, and the heat resistance. Therefore, Nickel is preferably contained at 2.0% by mass or more. However, more than 8.0% by mass of nickel increases the opposite aggressibility to mating material. Thus, the nickel content is preferably limited to 2.0% to 8.0% by mass.

Cr: 3.0% to 13.0% by mass,

Chromium is contained in the base matrix phase and the hard particles, and increases the wear resistance. So Chromium is preferably contained at 3.0% by mass or more. However, more than 13% by mass of chromium increases the opposite aggressibility to mating material. Thus, the chromium content is preferably limited to 3.0% to 13.0% by mass.

Mo: 7.0% to 15.0% by mass

Molybdenum is contained in the base matrix phase and the hard particles, and increases the wear resistance. Therefore, Molybdenum is contained preferably at 7.0% by mass or more. However, more than 15.0% by mass of molybdenum increases the opposite aggressibility to mating material. Thus, the molybdenum content is preferably limited to 7.0% to 15.0% by mass.

Cu: 0.5% to 4.0% by mass

Copper is contained in the base matrix phase and reinforces the base matrix phase. Therefore, Copper is contained preferably at 0.5% by mass or more. However, when the copper content exceeds 4.0% by mass, the effects level off and therefore the cost effectiveness decreases. Thus, the copper content is preferably limited to 0.5% to 4.0% by mass.

Co: 12.0% to 26.0% by mass

Cobalt is contained in the base matrix phase and the hard particles, and improves the self-lubricating property, the bonding between the hard particles and the base matrix phase, and the wear resistance. Therefore, Cobalt is contained preferably at 12.0% by mass or more. However, when the cobalt content exceeds 26.0% by mass, the effect levels off and therefore the cost effectiveness decreases. Thus, the cobalt content is preferably limited to 12.0% to 26.0% by mass.

The balance of the base matrix in the iron-based sintered alloy material according to the present invention are iron and unavoidable impurities.

In addition to the hard particles, solid lubricant particles may be dispersed in the iron-based sintered alloy material according to the present invention. The solid lubricant particles improve machinability and prevent adhesion during operation. These effects are remarkable when the solid lubricant particles are dispersed at 0.2% by area or more.

However, when the solid lubricant particles are dispersed at more than 3.0% by area, the effects level off and therefore the cost effectiveness decreases. Thus, the content of the solid lubricant is preferably limited to 0.2% to 3.0% by area. Preferably, the solid lubricant is at least one sulfide, such as MnS, or at least one fluoride, such as $CaF_2$, or a combination thereof.

The following is a preferred method for manufacturing the sintered alloy material for a valve seat according to the present invention.

A raw material powder is composed of a pure iron powder, an alloy steel powder, and/or an alloying element powder, which forms a base matrix phase, and first and second hard particles having the above-mentioned sizes and hardness and preferably having the above-mentioned compositions. This raw material powder and an optional solid lubricant are blended mixed and kneaded to produce a mixed powder so as to achieve the above-mentioned composition of the base matrix and the area ratios of the hard particles and the solid lubricant particles.

The raw material powder for forming the base matrix phase may be mixed by adding the alloying element powder to the pure iron powder, the alloying element powder to the alloy steel powder, or the alloying element powder to the pure iron powder and the alloy steel powder, to achieve the above-mentioned composition of the base matrix. Preferably, the alloy steel powder is used for the homogeneous dispersion of the alloying element.

Then, the mixed powder is filled into a mold and compressed, for example, with a forming press into a compact. Then, the compact is sintered in a protective atmosphere, such as in a dissociated ammonia gas or in a vacuum, preferably at a temperature of 1200° C. from 1100° C. to obtain an iron-based sintered alloy material.

The resulting iron-based sintered alloy material is cut or ground into a valve seat having a predetermined geometry for an internal combustion engine.

EXAMPLE

As a raw material powder, an alloying element powder and hard particles, or further solid lubricant particles were blended to an alloy steel powder and/or a pure iron powder of which types and amounts were shown in Table 1. The raw material powders were mixed and kneaded to obtain a mixed powder. The amount of the solid lubricant particles shown in Table 1 is expressed in parts by weight to a hundred parts by weight of the total amount of the alloy steal powder, the pure iron powder, the alloy element powder and the hard particles. Each amount of the alloy steel powder, the pure iron powder, the alloying element powder, and the hard particles is expressed in % by mass to the total amount of the alloy steel powder, the pure iron powder, the alloy element powder and the hard particles. Samples 1 to 16 contain no solid lubricant particles, and samples 17 to 37 contain the solid lubricant particles. Table 2 shows the types and compositions of the alloy steel powders; Table 3 shows the types and compositions of the hard particles; and Table 4 shows the types of the solid lubricant particles.

The mixed powder was then filled in a mold and was compressed with a forming press into a compact.

Then, the compact was sintered at a temperature of 1200° C. from 1000° C. in a protective atmosphere to obtain an iron-based sintered alloy material.

Test pieces were prepared from the iron-based sintered alloy material. The composition of the base matrix, the sizes, the area ratios, and the hardness of hard particles and the solid lubricant particles were measured using the test pieces. The sizes and the area ratios of the hard particles and the area ratios of the solid lubricant particles were determined by analyzing 20 particles or more in a ground surface of the test piece with an image analyzing apparatus. The hardness was measured in 20 particles or more with a microvickers hardness tester (load: 1 N) and the values of the hardness were averaged.

Figure 2:
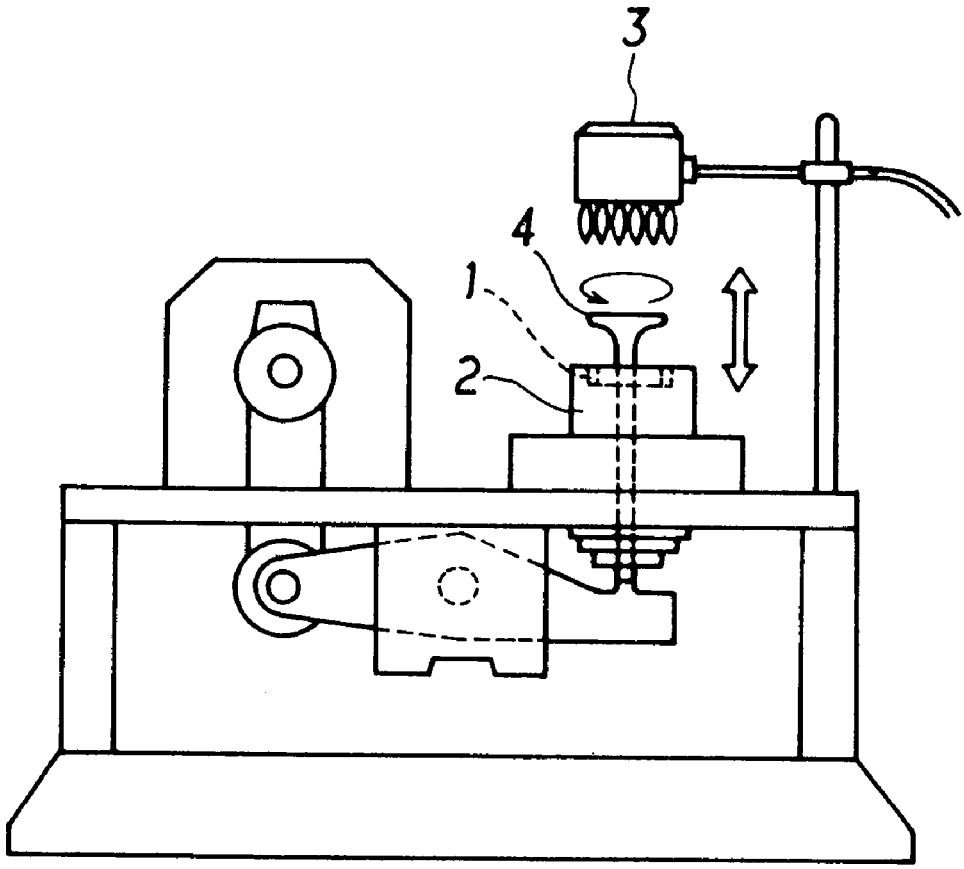
FIG. 2 is a schematic view of a single piece wear test on rig.

The iron-based sintered alloy material was cut or ground into a valve seat (33 mm O.D.×27 mm I.D.×7.5 mm H.). The valve seat was subjected to a single piece wear test on rig shown in FIG. 2 to evaluate the wear resistance and the opposite aggressibility to mating material. A valve seat 1 was press-fit into a jig 2 corresponding to a cylinder head. A valve 4 was moved up and down by a crank chain while the valve 4 and the valve seat 1 were heated with a heat source 3. Finally, the wear loss was measured. The test conditions were as follows:

Test temperature: 400° C. (at a surface of the seat)

Test time: 9 hours

Rotation speed of cam: 3000 rpm

Rotation speed of valve: 20 rpm

Spring load: 345 N (initial)

Valve material: heat-resisting steel

Lift distance: 9.0 mm

The results are shown in Table 5. The sizes and hardness of the hard particles and the solid lubricant particles in the iron-based sintered alloy material did not vary significantly and were omitted from Table 5.

In samples 1 to 16 according to the present invention, the wear losses of the valve seats were 11 to 19 μm, and the wear losses of mating valves were 7 to 12 μm. This demonstrates that the iron-based sintered alloy material according to the present invention has excellent wear resistance. In samples 17 to 23 containing the solid lubricant according to the present invention, 0.2% to 3% by area of the solid lubricant further improved the wear resistance of both the mating valve and the valve seat. Specifically, when the samples 17, 19, and 20 are compared with the sample 13, which has the same composition of the base matrix as the samples 17, 19, and 20 but does not contain the solid lubricant, the wear loss of the valve seat decreases from 16 μm to 10-13 μm, and that of the valve decreases from 10 μm to 5-7 μm, indicating that the opposite aggressibility to mating material is particularly reduced. On the other hand, the sample 18 according to the present invention, which contains 0.1% by area of the solid lubricant, exhibits almost the same wear resistance as the samples 1 to 16, indicating the effect of the solid lubricant is not significant. In samples 24 to 37 outside the scope of the present invention (comparative examples), the wear losses of the valve seats were 32 to 47 μm, and the wear losses of the mating valves were 14 to 35 μm. Thus, the wear resistance of the comparative examples decreases and the opposite aggressibility to mating material of the comparative examples increases as compared with the examples of the present invention.

Accordingly, the present invention has a significant industrial advantage in that a valve seat composed of iron-based sintered alloy material and having improved wear resistance and reduced opposite aggressibility to a mating valve can be manufactured at low cost.

TABLE 1

| | Raw material powders (% by mass)* | | | | | | | | | | | |
|---|---|---|---|---|---|---|---|---|---|---|---|---|
| | | | | | | Hard particles | | | | | Solid lubricant particles | |
| | Pure iron | Alloy steel powder | | Alloying element powder | | First hard particles | | Second hard particles | | | | Content (parts by |
| Sample | powder | Type** | Content | Type: content | Subtotal | Type*** | Content | Type*** | Content | Subtotal | Type**** | weight)***** |
| 1 | — | C | 66.0 | C: 1.0 | 1.0 | a1 | 15.0 | b1 | 18.0 | 33.0 | — | — |
| 2 | — | C | 51.8 | C: 1.2 | 1.2 | a1 | 12.0 | b1 | 35.0 | 47.0 | — | — |
| 3 | — | C | 51.8 | C: 1.2 | 1.2 | a3 | 12.0 | b1 | 35.0 | 47.0 | — | — |
| 4 | — | C | 51.8 | C: 1.2 | 1.2 | a4 | 12.0 | b1 | 35.0 | 47.0 | — | — |
| 5 | — | C | 51.8 | C: 1.2 | 1.2 | a5 | 12.0 | b1 | 35.0 | 47.0 | — | — |
| 6 | — | C | 44.9 | C: 1.1 | 1.1 | a1 | 19.0 | b1 | 35.0 | 54.0 | — | — |
| 7 | — | C | 60.0 | C: 1.0 | 1.0 | a2 | 19.0 | b1 | 20.0 | 39.0 | — | — |
| 8 | — | C | 67.0 | C: 1.0 | 1.0 | a2 | 12.0 | b1 | 20.0 | 32.0 | — | — |
| 9 | — | C | 67.0 | C: 1.0 | 1.0 | a2 | 12.0 | b2 | 20.0 | 32.0 | — | — |
| 10 | — | C | 67.0 | C: 1.0 | 1.0 | a2 | 12.0 | b3 | 20.0 | 32.0 | — | — |
| 11 | — | C | 67.0 | C: 1.0 | 1.0 | a2 | 12.0 | b4 | 20.0 | 32.0 | — | — |
| 12 | 16.8 | C | 47.0 | C: 1.2 | 1.2 | a2 | 15.0 | b1 | 20.0 | 35.0 | — | — |
| 13 | 5.0 | C | 58.0 | C: 1.0 | 1.0 | a2 | 13.0 | b1 | 23.0 | 36.0 | — | — |
| 14 | — | B | 64.5 | C: 1.0, Ni: 1.5, Cu: 1.0 | 3.5 | a1 | 12.0 | b1 | 20.0 | 32.0 | — | — |
| 15 | — | B | 43.0 | C: 1.0, Ni: 1.0, Cu: 1.0 | 3.0 | a1 | 19.0 | b1 | 35.0 | 54.0 | — | — |
| 16 | 55.0 | — | — | C: 1.0, Ni: 1.5, Cu: 1.5, Mo: 2.0 | 6.0 | a2 | 19.0 | b1 | 20.0 | 39.0 | — | — |
| 17 | 5.0 | C | 58.0 | C: 1.0 | 1.0 | a2 | 13.0 | b1 | 23.0 | 36.0 | c1 | 0.50 |
| 18 | 5.0 | C | 58.0 | C: 1.0 | 1.0 | a2 | 13.0 | b1 | 23.0 | 36.0 | c1 | 0.05 |
| 19 | 5.0 | C | 58.0 | C: 1.0 | 1.0 | a2 | 13.0 | b1 | 23.0 | 36.0 | c1 | 0.15 |
| 20 | 5.0 | C | 58.0 | C: 1.0 | 1.0 | a2 | 13.0 | b1 | 23.0 | 36.0 | c1 | 2.50 |
| 21 | — | B | 64.5 | C: 1.0, Ni: 1.5, Cu: 1.0 | 3.5 | a1 | 12.0 | b1 | 20.0 | 32.0 | c1 | 0.50 |
| 22 | — | B | 43.0 | C: 1.0, Ni: 1.0, Cu: 1.0 | 3.0 | a1 | 19.0 | b1 | 35.0 | 54.0 | c2 | 1.50 |
| 23 | 55.0 | — | — | C: 1.0, Ni: 1.5, Cu: 1.5, Mo: 2.0 | 6.0 | a2 | 19.0 | b1 | 20.0 | 39.0 | c2 | 0.50 |
| 24 | — | C | 69.0 | C: 1.0 | 1.0 | a1 | 10.0 | b1 | 20.0 | 30.0 | c1 | 0.50 |
| 25 | — | C | 74.0 | C: 1.0 | 1.0 | a1 | 10.0 | b1 | 15.0 | 25.0 | c1 | 1.00 |
| 26 | — | C | 71.0 | C: 1.0 | 1.0 | a1 | 13.0 | b1 | 15.0 | 28.0 | c1 | 1.00 |
| 27 | — | B | 53.0 | C: 1.0, Ni: 1.0, Cu: 1.0 | 3.0 | a2 | 24.0 | b1 | 20.0 | 44.0 | c2 | 1.00 |
| 28 | — | B | 33.0 | C: 1.0, Ni: 1.0, Cu: 1.0 | 3.0 | a2 | 24.0 | b1 | 40.0 | 64.0 | c2 | 1.50 |
| 29 | — | A | 46.8 | C: 1.2 | 1.2 | a1 | 12.0 | b1 | 40.0 | 52.0 | c1 | 1.00 |
| 30 | — | B | 63.0 | C: 1.0 | 1.0 | a6 | 13.0 | b1 | 23.0 | 36.0 | c2 | 1.00 |
| 31 | — | B | 62.8 | C: 1.2 | 1.2 | a6 | 13.0 | b5 | 23.0 | 36.0 | c2 | 1.00 |
| 32 | — | B | 63.0 | C: 1.0 | 1.0 | a2 | 13.0 | b5 | 23.0 | 36.0 | c1 | 0.50 |
| 33 | 36.0 | A | 30.0 | C: 1.0, Cu: 1.0 | 2.0 | a2 | 12.0 | b1 | 20.0 | 32.0 | c2 | 0.50 |
| 34 | — | B | 64.5 | C: 1.0, Ni: 1.5, Cu: 1.0 | 3.5 | a7 | 12.0 | b6 | 20.0 | 32.0 | c1 | 0.50 |
| 35 | — | B | 64.5 | C: 1.0, Ni: 1.5, Cu: 1.0 | 3.5 | a8 | 12.0 | b7 | 20.0 | 32.0 | c1 | 0.50 |
| 36 | — | B | 64.5 | C: 1.0, Ni: 1.5, Cu: 1.0 | 3.5 | a1 | 12.0 | b1 | 20.0 | 32.0 | c1 | 2.50 |
| 37 | 69.5 | A | 5.0 | C: 1.0, Cu: 1.5, Co: 1.0 | 3.5 | a1 | 12.0 | b5 | 10.0 | 22.0 | c1 | 0.50 |

*% by mass based on the total amount of (pure iron powder + alloy steel powder + alloying element powder + hard particles)

**see Table 2

***see Table 3

****see Table 4

*****Parts by weight to 100 parts by weight of the total amount of (pure iron powder + alloy steel powder + alloying element powder + hard particles)

TABLE 2

| Type of alloy steel powder | Composition of alloy steel powder (% by mass) |
|---|---|
| A | 3.0% Cr-0.2% Mo-bal.Fe |
| B | 0.6% Ni-1.0% Mo-bal.Fe |
| C | 4.0% Ni-1.5% Cu-0.5% Mo-bal.Fe |

TABLE 3

| | Hard particles | | | | |
|---|---|---|---|---|---|
| Type of Hard particles | Type | Composition (% by mass) | Average diameter (μm) | Size distribution (μm) | Hardness HV0.1 |
| a1 | Co-based intermetallic compound | 9.0% Cr-30.0% Mo-3.0% Si-bal. Co | 70 | 10-140 | 700 |
| a2 | Co-based intermetallic compound | 18.0% Cr-30.0% Mo-3.5% Si-bal. Co | 80 | 10-150 | 750 |
| a3 | Co-based intermetallic compound | 9.0% Cr-30.0% Mo-3.0% Si-bal. Co | 40 | 10-60 | 700 |
| a4 | Co-based intermetallic compound | 9.0% Cr-30.0% Mo-3.0% Si-bal. Co | 120 | 40-150 | 700 |
| a5 | Co-based intermetallic compound | 7.0% Cr-22.0% Mo-2.0% Si-bal. Co | 60 | 10-130 | 550 |
| a6 | Carbide-dispersed particles | 1.0% C-5.0% Mo-6.0% W-2.0% V-4.1% Cr-bal. Fe | 100 | 30-150 | 600 |
| a7 | Co-based intermetallic compound | 18.0% Cr-30.0% Mo-3.5% Si-bal. Co | 5 | 0.1-10 | 750 |
| a8 | Co-based intermetallic compound | 18.0% Cr-30.0% Mo-3.5% Si-bal. Co | 180 | 100-250 | 750 |
| b1 | Co-based intermetallic compound | 10.0% Ni-25.0% Cr-25.0% Mo-2.0% Si-bal. Co | 60 | 10-130 | 1050 |
| b2 | Co-based intermetallic compound | 10.0% Ni-25.0% Cr-25.0% Mo-2.0% Si-bal. Co | 30 | 10-50 | 1050 |
| b3 | Co-based intermetallic compound | 10.0% Ni-25.0% Cr-25.0% Mo-2.0% Si-bal. Co | 130 | 50-150 | 1050 |
| b4 | Co-based intermetallic compound | 9.0% Ni-18.0% Cr-20.0% Mo-2.0% Si-bal. Co | 70 | 10-140 | 850 |
| b5 | Fe—Mo particles | 60.0% Mo-bal. Fe | 100 | 30-150 | 1200 |
| b6 | Co-based intermetallic compound | 10.0% Ni-25.0% Cr-25.0% Mo-2.0% Si-bal. Co | 5 | 0.1-10 | 1050 |
| b7 | Co-based intermetallic compound | 10.0% Ni-25.0% Cr-25.0% Mo-2.0% Si-bal. Co | 180 | 100-250 | 1050 |

TABLE 4

| Type of solid lubricant | Solid lubricant |
|---|---|
| c1 | MnS |
| c2 | $CaF_2$ |

TABLE 5

| | Sintered alloy material | | | | | | | | | | |
|---|---|---|---|---|---|---|---|---|---|---|---|
| | Composition of base matrix (% by mass) | | | | | | | | | Hard particles First hard particles | |
| Sample | C | Si | Ni | Cr | Mo | Cu | Co | Others | Balance | Type | % by area |
| 1 | 1.00 | 0.75 | 4.44 | 5.60 | 8.93 | 0.98 | 16.20 | | Fe | a1 | 14.0 |
| 2 | 1.20 | 1.01 | 5.57 | 9.42 | 12.08 | 0.78 | 21.20 | | Fe | a1 | 11.0 |
| 3 | 1.20 | 1.01 | 5.57 | 9.42 | 12.08 | 0.78 | 21.20 | | Fe | a3 | 11.0 |
| 4 | 1.20 | 1.01 | 5.57 | 9.42 | 12.08 | 0.78 | 21.20 | | Fe | a4 | 11.0 |
| 5 | 1.20 | 0.94 | 5.57 | 9.42 | 11.34 | 0.78 | 22.28 | | Fe | a5 | 11.0 |
| 6 | 1.10 | 1.19 | 5.30 | 10.02 | 14.04 | 0.67 | 25.40 | | Fe | a1 | 18.0 |
| 7 | 1.00 | 1.05 | 4.40 | 8.13 | 10.52 | 0.90 | 17.60 | | Fe | a2 | 18.0 |
| 8 | 1.00 | 0.81 | 4.68 | 6.90 | 8.56 | 1.01 | 14.07 | | Fe | a2 | 11.0 |
| 9 | 1.00 | 0.81 | 4.68 | 6.90 | 8.56 | 1.01 | 14.07 | | Fe | a2 | 11.0 |
| 10 | 1.00 | 0.81 | 4.68 | 6.90 | 8.56 | 1.01 | 14.07 | | Fe | a2 | 11.0 |
| 11 | 1.00 | 0.82 | 4.68 | 6.90 | 8.74 | 1.00 | 13.80 | | Fe | a2 | 11.0 |
| 12 | 1.20 | 0.91 | 3.88 | 7.43 | 9.31 | 0.71 | 15.59 | | Fe | a2 | 14.0 |
| 13 | 1.00 | 0.91 | 4.62 | 7.80 | 9.52 | 0.87 | 15.78 | | Fe | a2 | 12.0 |
| 14 | 1.00 | 0.72 | 3.86 | 5.82 | 8.91 | 1.00 | 15.20 | | Fe | a1 | 11.0 |
| 15 | 1.00 | 1.20 | 4.74 | 10.02 | 14.28 | 1.00 | 25.40 | | Fe | a1 | 18.0 |

TABLE 5-continued

| | | | | | | | | | | | |
|---|---|---|---|---|---|---|---|---|---|---|---|
| 16 | 1.00 | 1.05 | 3.50 | 8.13 | 12.22 | 1.50 | 17.61 | | Fe | a2 | 18.0 |
| 17 | 1.00 | 0.91 | 4.62 | 7.80 | 9.52 | 0.87 | 15.78 | | Fe | a2 | 12.0 |
| 18 | 1.00 | 0.91 | 4.62 | 7.80 | 9.52 | 0.87 | 15.78 | | Fe | a2 | 12.0 |
| 19 | 1.00 | 0.91 | 4.62 | 7.80 | 9.52 | 0.87 | 15.78 | | Fe | a2 | 12.0 |
| 20 | 1.00 | 0.91 | 4.62 | 7.80 | 9.52 | 0.87 | 15.78 | | Fe | a2 | 12.0 |
| 21 | 1.00 | 0.72 | 3.86 | 5.82 | 8.91 | 1.00 | 15.20 | | Fe | a1 | 11.0 |
| 22 | 1.00 | 1.20 | 4.74 | 10.02 | 14.28 | 1.00 | 25.40 | | Fe | a1 | 18.0 |
| 23 | 1.00 | 1.05 | 3.50 | 8.13 | 12.22 | 1.50 | 17.61 | | Fe | a2 | 18.0 |
| 24 | 1.00 | 0.66 | 4.76 | 5.65 | 8.00 | 1.04 | 14.00 | | Fe | a1 | 8.0 |
| 25 | 1.00 | 0.56 | 4.46 | 4.45 | 6.82 | 1.11 | 12.00 | | Fe | a1 | 8.0 |
| 26 | 1.00 | 0.64 | 4.34 | 4.71 | 7.66 | 1.07 | 13.80 | | Fe | a1 | 12.0 |
| 27 | 1.00 | 1.22 | 3.30 | 9.00 | 12.21 | 1.00 | 20.14 | | Fe | a2 | 22.0 |
| 28 | 1.00 | 1.62 | 5.18 | 13.80 | 19.79 | 1.00 | 28.14 | | Fe | a2 | 22.0 |
| 29 | 1.20 | 1.11 | 4.00 | 12.62 | 13.12 | — | 23.20 | V: 0.13 | Fe | a1 | 11.0 |
| 30 | 1.20 | 0.51 | 2.65 | 0.05 | 6.83 | — | 9.20 | V: 0.26, W: 0.75 | Fe | a6 | 12.0 |
| 31 | 1.32 | 0.05 | 0.35 | 0.53 | 15.11 | — | — | V: 0.26, W: 0.75 | Fe | a6 | 12.0 |
| 32 | 1.00 | 0.45 | 0.35 | 2.28 | 18.18 | — | 6.58 | | Fe | a2 | 12.0 |
| 33 | 1.00 | 0.87 | 2.30 | 8.52 | 9.01 | 1.00 | 15.27 | | Fe | a2 | 11.0 |
| 34 | 1.00 | 0.81 | 3.86 | 6.90 | 8.91 | 1.00 | 14.07 | | Fe | a7 | 11.0 |
| 35 | 1.00 | 0.81 | 3.86 | 6.90 | 8.91 | 1.00 | 14.07 | | Fe | a8 | 11.0 |
| 36 | 1.00 | 0.72 | 3.86 | 5.82 | 8.91 | 1.00 | 15.02 | | Fe | a1 | 11.0 |
| 37 | 1.00 | 0.31 | 1.50 | 1.17 | 9.43 | 1.00 | 7.20 | | Fe | a1 | 11.0 |

| | Sintered alloy material | | | | Results Single piece wear test on rig Wear loss (μm) | | |
|---|---|---|---|---|---|---|---|
| | Hard particles | | | Solid lubricant particles | | | |
| | Second hard particles | | Total percent | % by | | Valve | |
| Sample | Type | % by area | by area | area | Valve | seat | Remarks |
| 1 | b1 | 16.0 | 30.0 | — | 9 | 15 | Example of the |
| 2 | b1 | 34.0 | 45.0 | — | 11 | 12 | present invention |
| 3 | b1 | 34.0 | 45.0 | — | 10 | 11 | |
| 4 | b1 | 34.0 | 45.0 | — | 12 | 12 | |
| 5 | b1 | 34.0 | 45.0 | — | 10 | 14 | |
| 6 | b1 | 34.0 | 52.0 | — | 10 | 12 | |
| 7 | b1 | 19.0 | 37.0 | — | 7 | 16 | |
| 8 | b1 | 19.0 | 30.0 | — | 7 | 18 | |
| 9 | b2 | 19.0 | 30.0 | — | 7 | 16 | |
| 10 | b3 | 19.0 | 30.0 | — | 8 | 19 | |
| 11 | b4 | 19.0 | 30.0 | — | 10 | 18 | |
| 12 | b1 | 18.0 | 32.0 | — | 8 | 17 | |
| 13 | b1 | 22.0 | 34.0 | — | 10 | 16 | |
| 14 | b1 | 19.0 | 30.0 | — | 10 | 13 | |
| 15 | b1 | 34.0 | 52.0 | — | 11 | 11 | |
| 16 | b1 | 19.0 | 37.0 | — | 8 | 17 | |
| 17 | b1 | 22.0 | 34.0 | 0.8 | 5 | 10 | |
| 18 | b1 | 22.0 | 34.0 | 0.1 | 10 | 16 | |
| 19 | b1 | 22.0 | 34.0 | 0.2 | 7 | 13 | |
| 20 | b1 | 22.0 | 34.0 | 2.9 | 6 | 13 | |
| 21 | b1 | 19.0 | 30.0 | 0.8 | 5 | 8 | |
| 22 | b1 | 34.0 | 52.0 | 2.0 | 4 | 7 | |
| 23 | b1 | 19.0 | 37.0 | 0.8 | 5 | 10 | |
| 24 | b1 | 18.0 | 26.0 | 0.8 | 22 | 43 | Comparative example |
| 25 | b1 | 13.0 | 21.0 | 1.5 | 21 | 46 | |
| 26 | b1 | 13.0 | 25.0 | 1.5 | 28 | 44 | |
| 27 | b1 | 18.0 | 40.0 | 1.5 | 14 | 37 | |
| 28 | b1 | 38.0 | 60.0 | 2.1 | 35 | 32 | |
| 29 | b1 | 38.0 | 49.0 | 1.5 | 23 | 36 | |
| 30 | b1 | 22.0 | 34.0 | 1.5 | 23 | 39 | |
| 31 | b5 | 22.0 | 34.0 | 1.5 | 34 | 35 | |
| 32 | b5 | 22.0 | 34.0 | 0.8 | 25 | 36 | |
| 33 | b1 | 19.0 | 30.0 | 0.8 | 26 | 40 | |
| 34 | b6 | 19.0 | 30.0 | 0.8 | 29 | 47 | |
| 35 | b7 | 19.0 | 30.0 | 0.8 | 30 | 46 | |
| 36 | b1 | 19.0 | 30.0 | 3.5 | 18 | 34 | |
| 37 | b5 | 9.0 | 20.0 | 0.8 | 23 | 38 | |

*) see Table 3

What is claimed is:

1. An iron-based sintered alloy material for a valve seat, comprising:

a base matrix phase;

first hard particles; and second hard particles, wherein the first hard particles and the second hard particles have different hardness and are dispersed in the base matrix phase, the first hard particles are composed of a cobalt-based intermetallic compound and have a size of 10 to 150 μm and a hardness of 500HV0.1 or more and less than 800HV0.1, the second hard particles are composed of a cobalt-based intermetallic compound and have a size of 10 to 150 μm and a hardness of 800HV0.1 or more and less than 1100HV0.1, the first hard particles occupy 10% to 20% by area, the second hard particles occupy 15% to 35% by area, and the first hard particles and the second hard particles occupy 25% to 55% by area in total.

2. The iron-based sintered alloy material for a valve seat according to claim 1, wherein the first hard particles contain 0.5% to 4.0% by mass of Si, 5.0% to 20.0% by mass of Cr, and 20.0% to 40.0% by mass of Mo, the balance being Co and unavoidable impurities, and the second hard particles contain 0.5% to 4.0% by mass of Si, 5.0% to 20.0% by mass of Ni, 15.0% to 35.0% by mass of Cr, and 15.0% to 35.0% by mass of Mo, the balance being Co and unavoidable impurities.

3. The iron-based sintered alloy material for a valve seat according to claim 1 or 2, wherein a base matrix, which is composed of the base matrix phase and the first and the second hard particles, contains 0.5% to 3.0% by mass of C, 0.5% to 2.0% by mass of Si, 2.0% to 8.0% by mass of Ni, 3.0% to 13.0% by mass of Cr, 7.0% to 15.0% by mass of Mo, 0.5% to 4.0% by mass of Cu, and 12.0% to 26.0% by mass of Co, the balance being Fe and unavoidable impurities.

4. The iron-based sintered alloy material for a valve seat according claim 1 or 2, wherein, in addition to the first hard particles and the second hard particles, 0.2% to 3.0% by area of solid lubricant particles are dispersed in the base matrix phase.

5. A valve seat composed of the iron-based sintered alloy material according to claim 1 or 2.

6. The iron-based sintered alloy material for a valve seat according to claim 3, wherein, in addition to the first hard particles and the second hard particles, 0.2% to 3.0% by area of solid lubricant particles are dispersed in the base matrix phase.

7. A valve seat composed of the iron-based sintered alloy material according to claim 3.

8. A valve seat composed of the iron-based sintered alloy material according to claim 4.

9. A valve seat composed of the iron-based sintered alloy material according to claim 6.

* * * * *